United States Patent [19]

Greenwood

[11] 4,259,778

[45] Apr. 7, 1981

[54] PUNCH AND CRIMP APPARATUS

[75] Inventor: William S. Greenwood, Nutley, N.J.

[73] Assignee: Thomas & Betts Corporation, Raritan, N.J.

[21] Appl. No.: 42,534

[22] Filed: May 25, 1979

[51] Int. Cl.[3] ..... B26F 1/04; H01R 9/07

[52] U.S. Cl. ..... 29/560; 29/566.4; 29/747; 29/830; 83/549

[58] Field of Search ..... 29/566.1, 566.3, 566.4, 29/560, 741, 747, 749, 750, 751, 752, 753, 758, 830, 845; 83/549, 550, 551; 100/288

[56] References Cited

U.S. PATENT DOCUMENTS

| | | | |
|---|---|---|---|
| 3,846,894 | 11/1974 | Parsons et al. | 29/868 X |
| 4,005,518 | 2/1977 | Bakermans | 29/752 |
| 4,015,328 | 4/1977 | McDonough | 29/830 |
| 4,017,954 | 4/1977 | Grubb | 29/749 |
| 4,025,998 | 5/1977 | Eppler | 29/566.4 |

FOREIGN PATENT DOCUMENTS

| | | | |
|---|---|---|---|
| 683217 | 6/1930 | France | 83/549 |

*Primary Examiner*—Z. R. Bilinsky
*Attorney, Agent, or Firm*—James J. Daley; Robert M. Rodrick; Jesse Woldman

[57] ABSTRACT

A tool for the selective joining of the individual conductors of a multiconductor flat cable. The tool may be set according to indicia on a selection device to punch any pattern, which can be correctly employed, on the cables guided and oriented on the tool base. After punching, connectors are manually inserted through the punched apertures and the tool is reapplied to simultaneously crimp all of the connectors to complete the joints.

27 Claims, 23 Drawing Figures

PUNCH AND CRIMP APPARATUS

CROSS-REFERENCES TO RELATED APPLICATIONS

The methodology for tool punch pattern selection is set forth in (1) "Method for Electrical Connection of Flat Cables", U.S. Pat. No. 4,249,303 issued Feb. 10, 1981 by Karl Weinmann, Ted L. C. Kuo and William S. Greenwood and assigned to the Assignee of the instant invention, and (2) "Apparatus and Method for Electrical Connection of Multiconductor Cables", Ser. No. 042,442 filed May 25, 1979 by William S. Greenwood and assigned to the Assignee of the instant invention. The connectors are described in (3) "Self-Locking Clamp Member", U.S. Pat. No. 4,248,493 issued Feb. 3, 1981 by Ted. L. C. Kuo and assigned to the Assignee of the instant invention. The flat cable and its construction is set forth in (4) "Multiconductor Cable", Ser. No. 042,544 filed May 25, 1979 by Ted L. C. Kuo and Raymond F. Piasecki and assigned to the Assignee of the instant invention. All of these applications are considered made a part hereof by reference thereto.

BACKGROUND OF THE INVENTION

1. Field of the Invention

Tools to permit the joining of two or more objects and more particularly to the selective joining of the individual conductors of two multiconductor flat cables.

2. Description of the Prior Art

No devices are known of which accomplish the same task in the manner described herein. One approach used applies clips to the cable edges where conductors to be joined cross. These clips are insulation piercing and make contact with the bare wire of the conductors after crimping.

SUMMARY OF THE INVENTION

The present invention permits the selective joinder of the individual conductors of two multiconductor flat cables. The tool contains a series of punches either as an integral part of, or attachable thereto, which are selectively chosen in accordance with the number of conductors in the cable and their designations. Thus, by operating a selection device to prescribed indicia the tool will punch apertures in all conductors and only those conductors which must be joined. Connectors are then manually inserted into the apertures and the tool reaplied in a press manner to close simultaneously all of the connectors and make the desired joints between the individual conductors. It is an object of this invention to provide a novel dual function tool.

It is another object of this invention to provide a novel tool which can punch apertures during one cycle of operation and crimp connectors placed in those apertures during a further cycle of operation.

It is still another object of the invention to provide a tool which will punch selectively according to a pattern chosen by a selection device.

It is yet another object of the invention to provide a positionable selection device which controls the punching of the cable.

It is still another object of the invention to provide a novel cable punching device whose punch function does not interfere with the tool's later use as a press.

Other objects and features of the invention will be pointed out in the following description and claims and illustrated in the accompanying drawings, which disclose, by way of example, the principles of the invention, and the best modes contemplated for carrying them out.

BRIEF DESCRIPTION OF THE DRAWINGS

In the drawings in which similar elements are given similar reference characters.

DESCRIPTION OF THE PREFERRED EMBODIMENTS

Figure 1:
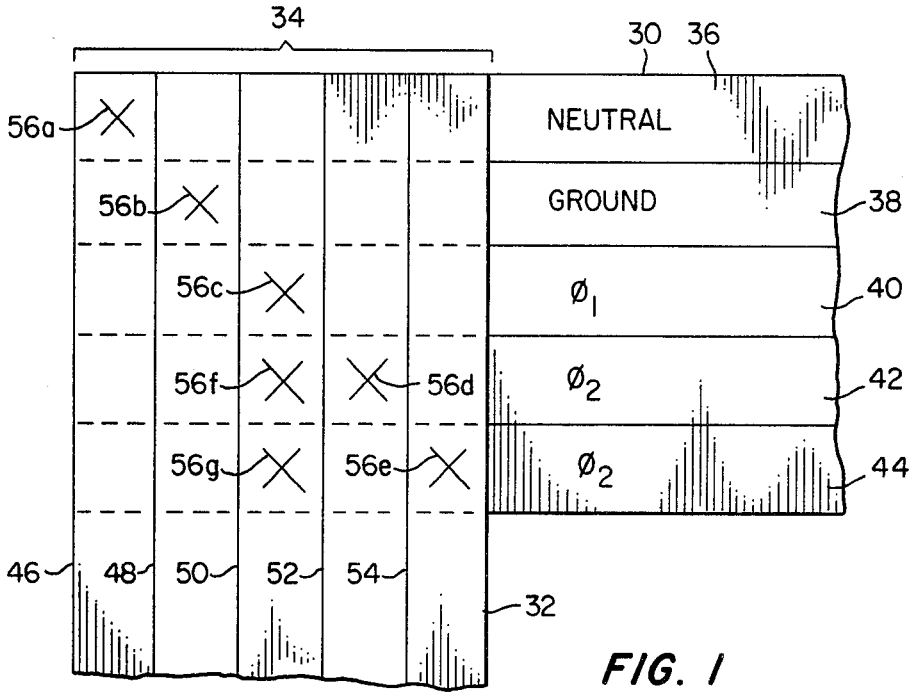
FIG. 1 is a representation of two multiconductor flat conductor cables with all useful interconnection positions noted.

FIG. 1 represents two five-conductor multiconductor flat cables 30, 32, as is more fully described in the above Application No. (4) positioned one atop the other and at right angles to one another showing all possible crossover points therebetween. Because both cables are five-conductor cables a 5×5 matrix 34 is created. The use of each of the conductors 36, 38, 40, 42 and 44 of cable 30 is set forth along the righthand margin of FIG. 1. Thus, conductor 36 is neutral, conductor 38 is ground, conductor 40 is phase 1, conductor 42 is phase 2 and conductor 44 is phase 3. If a full three-phase wiring system is desired, all conductors 36 to 44 would have to be connected to the conductors 46 to 54 of cable 32 on a one-to-one basis. If a single phase tap is to be made from cable 30 then only three of the conductors 36 to 44 would have to be used as is shown in FIG. 2 and only a three-conductor cable would have to be employed, as will be set forth below.

The X's 56*a* to 56*e* in the diagonal row are sufficient to interconnect each of the conductors 36 to 44 of cable 30 to corresponding individual conductors 46 to 54 of the cable 32 to provide a three-phase interconnection. However, to permit a three-conductor tap of the five-conductor cable 30, it is necessary to provide for two additional tap positions, namely, 56*f* and 56*g*, which together with 56*c* form a parallel tap line. Thus, if a phase one tap is needed, using a three-conductor tap cable (not shown), a connection would be made at 56*a*, 56*b* and 56*c*. If a phase two tap is needed, then a connection would be made at 56*a*, 56*b* and 56*f*. Similarly, a phase three tap would require connections at 56*a*, 56*b* and 56*g*. All other positions in the matrix 34 are superfluous. The theory and reasoning for this approach is set out in more detail in Applications (1) and (2) above.

Figure 2:
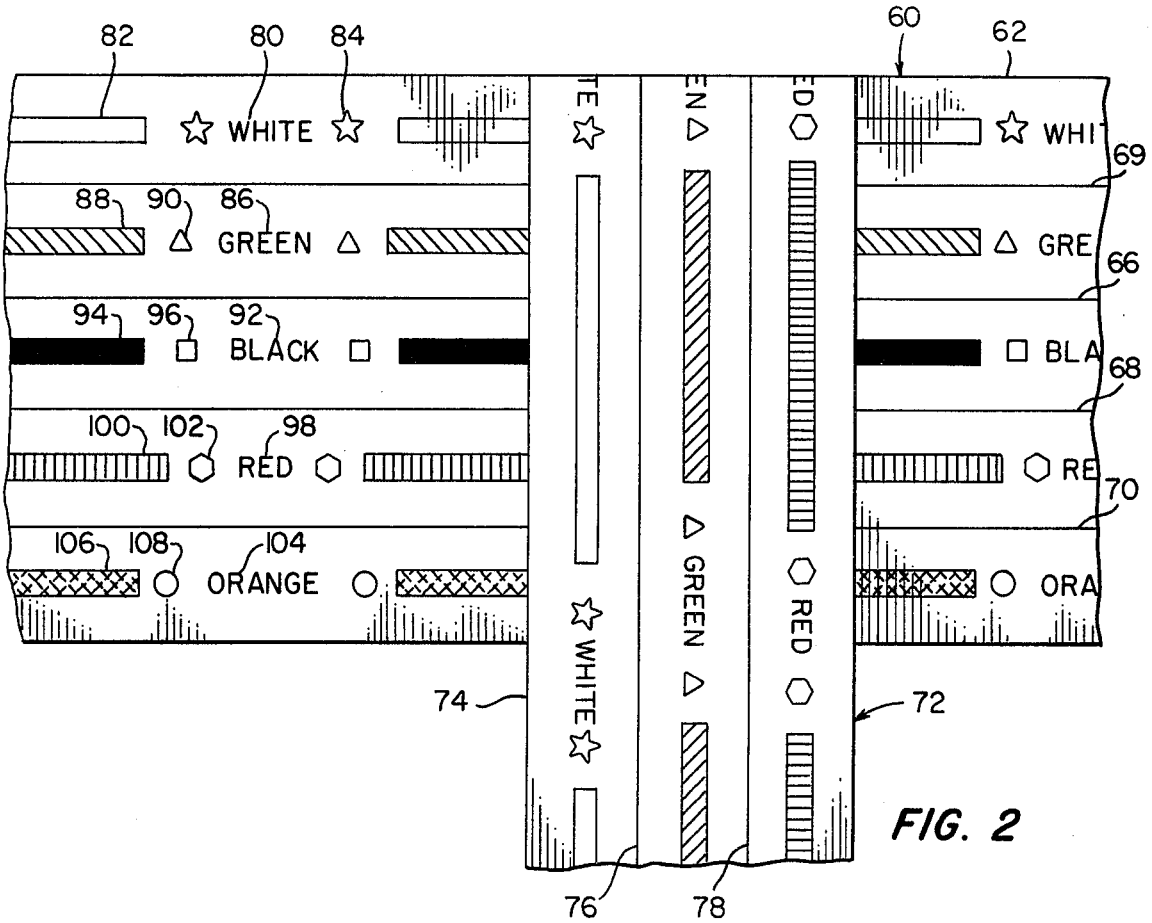
FIG. 2 is a top plan view of a three-conductor flat cable laid atop and at right angles to a five-conductor flat cable.

Turning to FIG. 2, a typical five-conductor cable 60 is shown with its five-conductors 62, 64, 66, 68 and 70. Placed atop cable 60 is a three-conductor cable 72 with its conductors 74, 76 and 78. Each of the conductors is marked for easy identification with its color name, a band of that color and a symbol of that color. Thus, conductor 62 is marked with the word "White" 80, the white band 82 and a star 84. Conductor 64 is marked with the word "Green" 86, the green band 88 and a triangle 90. Conductor 66 is similarly marked with the word "Black" 92, the black band 94 and the square 96, while conductor 68 is marked with the word "Red" 98, has a red band 100 and a hexagon 102. Finally, conductor 70 is marked with the word "Orange" 104, has an orange band 106 and a circular symbol 108. The five conductors 62 to 70 will serve the functions of neutral, ground, phase 1, phase 2 and phase 3, as was set out with respect to conductors 36 to 44 of cable 30 of FIG. 1.

The tap cable 72 is intended for a tap of phase 2 so that the neutral, ground and phase 2 conductors are necessary. Accordingly, cable 72 is marked with the proper colors to facilitate such a connection. Thus, if the installer installs white to white, green to green and red to red, a proper connection for phase 2 will be made. For a phase 1 connection the tap cable (not shown) will be white, green and black, while a phase 3 connection will require a cable, the conductors of which are marked "white", "green" and "orange".

Figure 3:
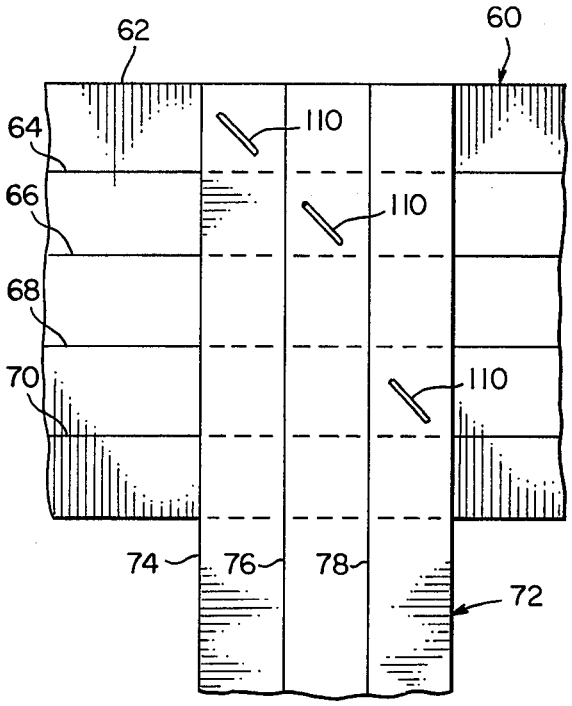
FIG. 3 is a top plan view of the punch pattern to join the flat cables of FIG. 2 in a specified pattern. The markings have been omitted to simplify the drawings.
Figure 5:
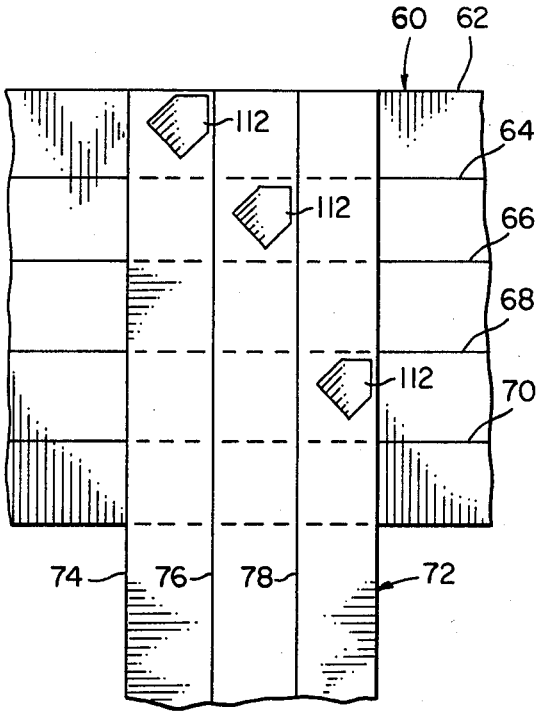
FIG. 5 is a top plan view of the cables of FIG. 3 with the joints completed.
Figure 4:
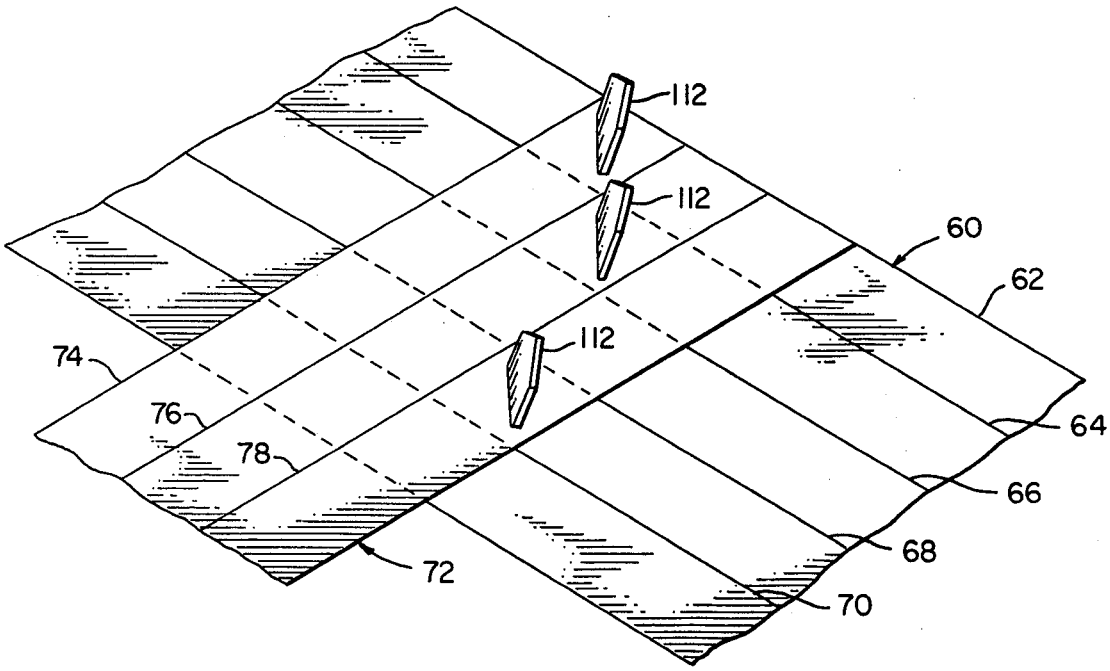
FIG. 4 is a perspective view of the cables of FIG. 3 with conductors inserted into the punch apertures.

Turning to FIGS. 3, 4 and 5, the tapping of the five-conductor flat cable 60 with a three-conductor flat cable 72 will be shown. Cable 72 is laid atop and orthogonal to cable 60 and slots 110 are punched at the locations 56*a*, 56*b* and 56*f* (see FIG. 1) to permit a phase 2 tap. Next, connectors 112, of the type more fully described in Application No. (3) above, are inserted in each of the slots 110, as is shown in FIG. 4. Finally, the connectors 112 are compressed by the tool of the instant Application to complete the tapping operation.

Reference is now made to FIGS. 6 to 12 where there are shown details of a first embodiment of a tool 120 for joining the individual conductors of two flat conductor cables 60 and 72 in accordance with the method set forth with respect to FIGS. 3, 4 and 5. Tool 120 has a base 122 used to support the tool 120 and provide back-up for the crimping operation which crimps the connectors 112 to the cables 60, 72 and die openings to receive the punches once they have passed through the cables. Guides 124 provide guide surfaces 126 and 126A to guide a five-conductor cable such as 60 through the tool. If less than a five-conductor cable, the cable edge must be placed along the guide surface 126. Further guide surfaces 128 and 130 are provided for a five-conductor cable extending orthogonally to cable 60. Again, to guide a cable of less than five conductors through the tool 120 said cable must be placed against guide 124 using guide surface 130. Guide surface 130 would effect an extension of cable 72 through tool 120.

Figure 6:
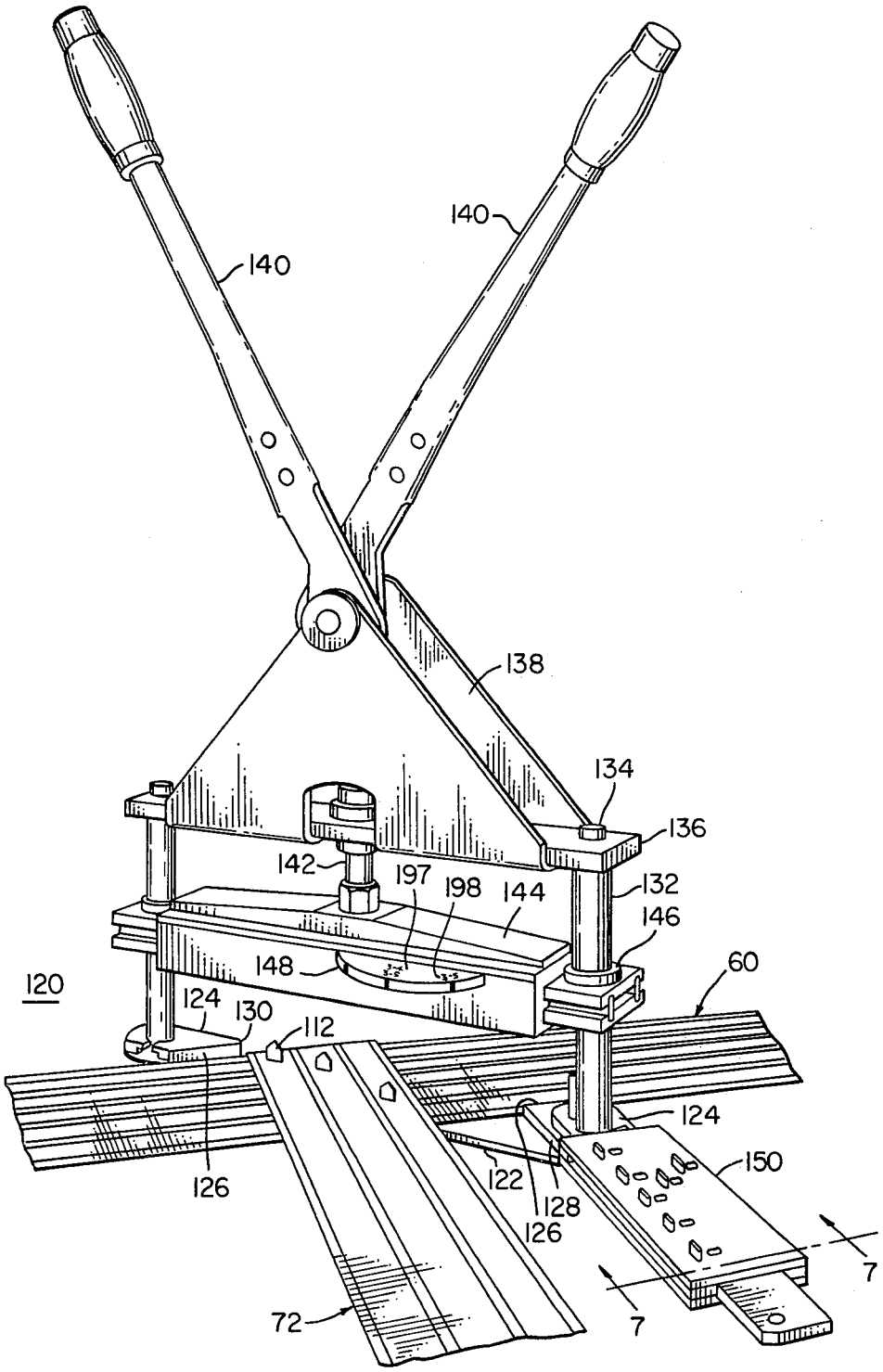
FIG. 6 is a perspective view of a first embodiment of a tool constructed in accordance with the concepts of the invention.
Figure 9:
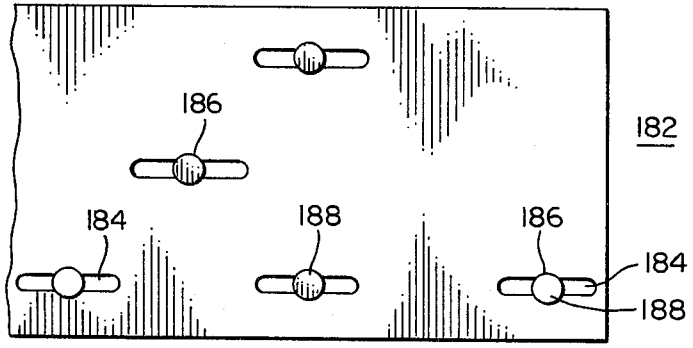
FIG. 9 is a bottom plan view of the presser plate of the tool of FIG. 6.

Two columns 132 extend perpendicularly upwardly from the base 122 one of which is releasably held in guide 124 to permit the upper part of tool 120 to be rotated away from base 122 to permit removal of the completed cable. Fastened to the upper portion of the column 132 as by fasteners 134 is a cross-frame 136 shrouded by the flanges 138. Dual handles 140 operate a dual toggle mechanism, as will be described below, to move a plunger 142. Coupled to the lower end of the plunger 142 is a yoke 144 driven towards and away from base 122. Yoke 144 as it moves is guided by the bearings, or bushings, 146 on the columns 132. A presser plate, a pin carriage and a selection mechanism are all coupled to the yoke 144, as will be described below. A selection dial 148 extends from the selection mechanism. A punch carrier 150 is pivotally coupled to the column 132 and is arranged to occupy the open position, as shown in FIG. 6, or the closed position overlying the base 122 and directly below the presser plate. Stated another way, yoke 144 constitutes a punch means to selectively operate the punch assembly or punch carrier 150 under the influence of the drive means operated by handles 140.

Figure 7:
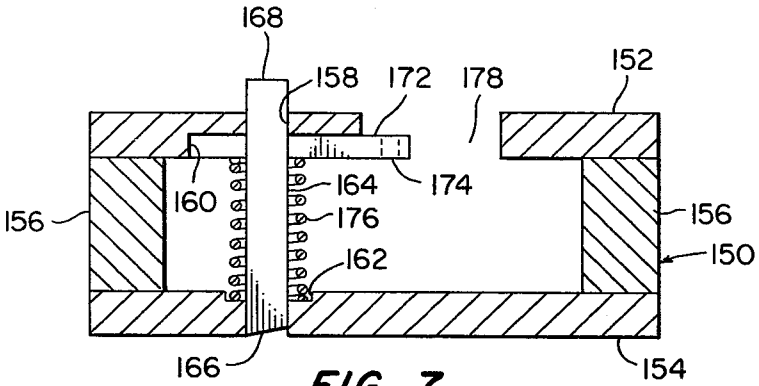
FIG. 7 is a sectional view taken along the lines 7–7 in FIG. 6 and showing the punch assembly used in the device of FIG. 6.
Figure 8:
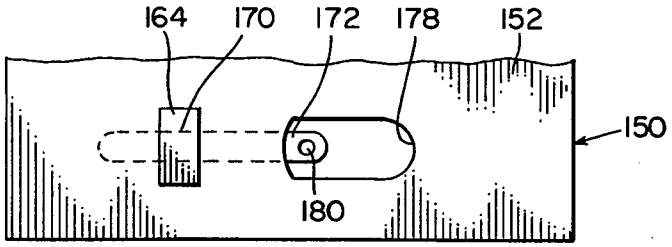
FIG. 8 is a top view of the section shown in FIG. 7.
Figure 12:
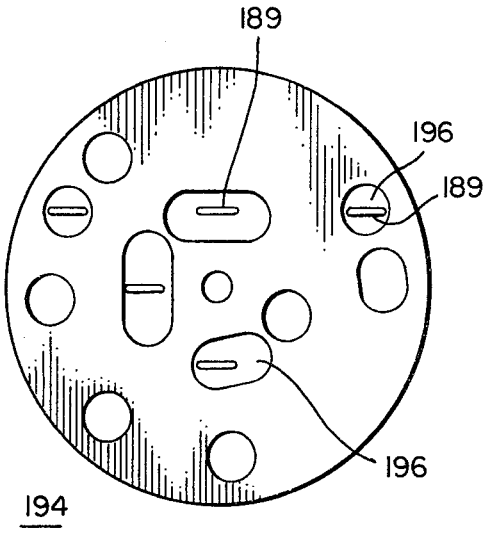
FIG. 12 is a top view of the selection dial of the tool of FIG. 6.

The punch carrier 150 is shown in greater detail in FIGS. 7 and 8. A top plate 152 is separated from a bottom plate 154 by spacers 156. Extending through top and bottom plates 152, 154, respectively, is a bore 158 counterbored as at 160 and 162, respectively. Extending within the bore 158 is a punch 164 having a sharpened punching end 166 and a push end 168 at the distal end. Intermediate the ends 166, 168 is a transverse slot 170 through which a pin 172 extends. Bearing upon the underside 174 of pin 172 and counterbore 162 is a coiled spring 176 which extends about the punch 164 and retains the punch 164 in the withdrawn position, as shown in FIG. 7, with the punching end 166 within the bore 158 at bottom plate 154 with the push end 168 extending fully above the upper plate 152. In this configuration, if the punch carrier 150 were brought into contact with a flat cable, no punching would take place. In order for a punch operation to occur, some object would have to act against the push end 168 to extend the punching end 166 below the bottom plate 154, as will be described below. Assuming such a punch extension would take place, the spring 176 would act to strip the punch 164 from the cable and reset it to the position shown in FIG. 7. A large slot 178 overlies a portion of the pin 172 which has an aperture 180 in this region to permit a tool to be inserted to withdraw the pin 172 from the punch 164 to permit its removal for sharpening and return to bore 158.

Figure 12A:
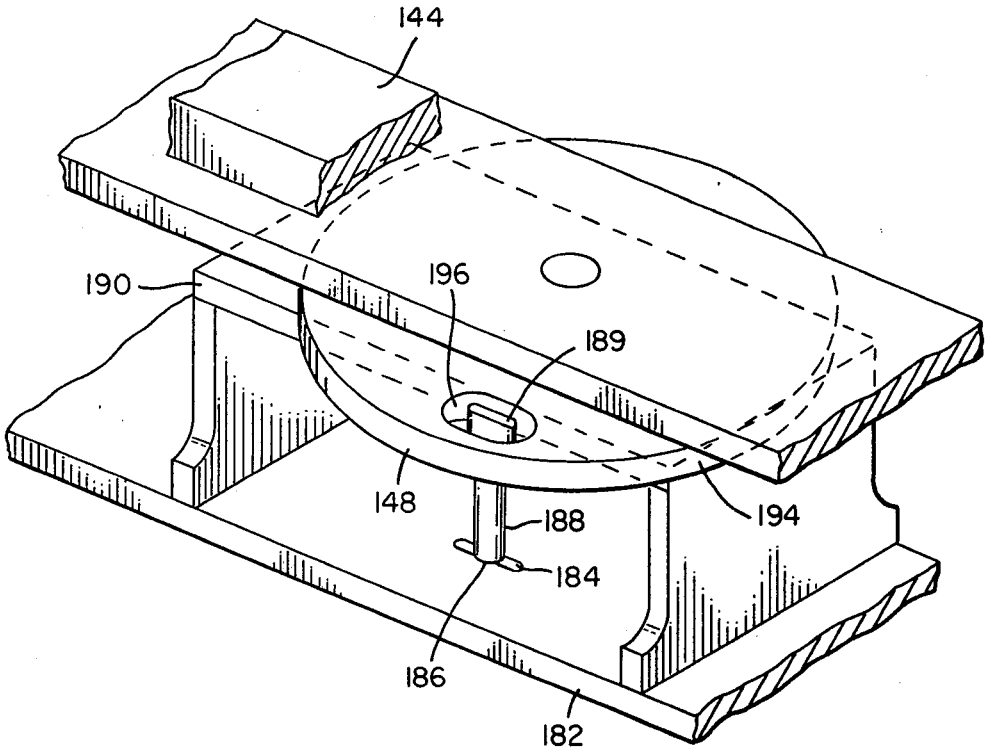
FIG. 12A is a fragmentary perspective assembly drawing of the parts of FIGS. 9, 10, 11 and 12.

The presser plate 182 (see FIGS. 9 and 12A) has a series of apertures 184 the shape of the push ends 168 of the punches 164 so that the push ends 168 may fully enter the apertures 184. Centrally located in apertures 184 are circular apertures 186 arranged to receive circular push pins 188. As will be described below, individual push pins 188 can be at the level of the bottom surface of the presser plate to block entry of the push ends 168 into the apertures 184 or the push pins 188 can be sufficiently withdrawn to permit such entry. When the push ends 168 of the punches 164 enter the apertures 184, no force is applied to displace the punches 164 from the position shown in FIG. 7 and as a result no punch operation will take place. However, when the push pins 188 are extended and block the entry to the apertures 184, the push pins 188 will bear against the push ends 168 of the punches 164, causing the punching end 166 to extend below bottom plate 154, causing the punching of the cable as yoke 144 is driven towards base 122 with the punch carrier 150 in the closed position. The push pins 188 will also be maintained in their entry blocking position during the crimping cycle so that a uniform force is applied to the connectors 112 across the entire presser plate 182.

Figure 10:
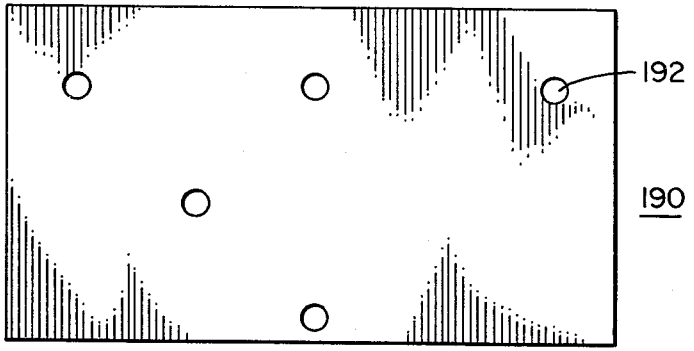
FIG. 10 is a top plan view of the pin carriage of the selection device of the tool of FIG. 6.
Figure 11:
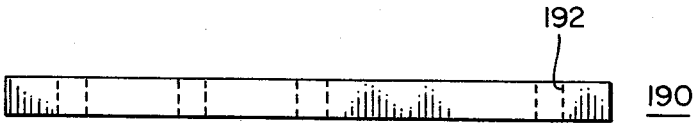
FIG. 11 is a side elevation of the pin carriage of FIG. 10.

FIGS. 10 and 11 show the push pin support carriage 190 which supports the push pins 188 between the presser plate 182 and the selection mechanism. A series of apertures 192 matching the series of apertures 184 in the presser plate 182 and die apertures in the base 122 is provided. No provision is made for retraction of the punches for positions corresponding to the neutral and ground since they must be punched under all conditions. Selection mechanism 194 is made up of a series of slots and circular cutouts 196 into which the flattened ends 189 of the push pins 188 are permitted to enter and solid regions which back up the push pins 188. If the push pin 188 end 189 enters a slot or circular cutout 196 it will not support the push pin 188 and no force will be applied to the push end 168 of the punch 164. Engagement of a solid area by the end 189 of a push pin 188 fixes the position of the pin and assures that it will bear against the push end 168 of punch 164 and cause same to be extended and punch as set out above. The selection mechanism 194 top surface 197 is marked with a series of indicia 198 so that the operator can set the tool to the combination he desires and get only the punches he needs. Thus, the operator turns selection dial 148 until the indicia 198 is correctly positioned. For example, for the phase 2 connection of FIGS. 3, 4 and 5 to the code "WGR" so that only punches 164 for the white, green and red positions will be operated.

Figure 13:
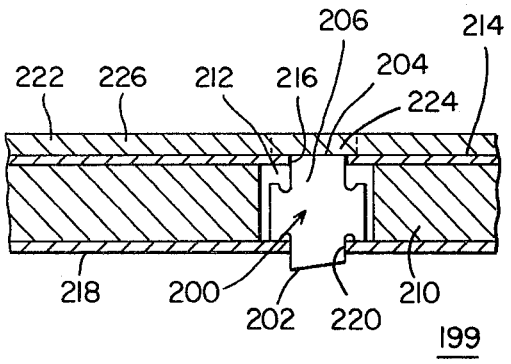
FIG. 13 is a side elevation of the punch and support in a further embodiment of a tool constructed in accordance with the invention.

FIG. 13 shows a simplified punch assembly 199 which omits the stripping and bias springs of the punch 164 of FIGS. 7 and 8. Punches 200 have sharpened punching ends 202, push ends 204 and a pair of shoulders 206 therebetween. Punch carrier 208 has a central spacer 210 with a chamber 212 therein. A top plate 214 has a bore 216 which permits the push end 204 to extend therethrough but prevents the shoulders 206 from passing. Similarly, bottom plate 218 has a bore 220 which permits the punching end 202 to extend therethrough but prevents the shoulders 206 from passing, resulting in a loose retention of the shoulders 206 in the chamber 212. A selection plate 222, shown in more detail in FIG. 14, rides directly above the top plate 214. Based upon the combination chosen, in the manner described above with respect to selection dial 148, the push end 204 of punch 200 will see either a slot 224 or solid areas 226 of the plate 222. If a slot 224 appears, then as the punch assembly 199 descends, the contact between the cable and the punch 200 will permit it to retract with the push end 204 entering the slot 224 so that the cable will not be punched. On the other hand, if a solid area appears, then as the punch assembly 199 descends, the push end 204 will contact such solid area and be supported by it, thus holding the punching end extended below bottom plate 218, as is shown in FIG. 13, and cause punching of the flat cable on an appropriate tool base.

Figure 14:
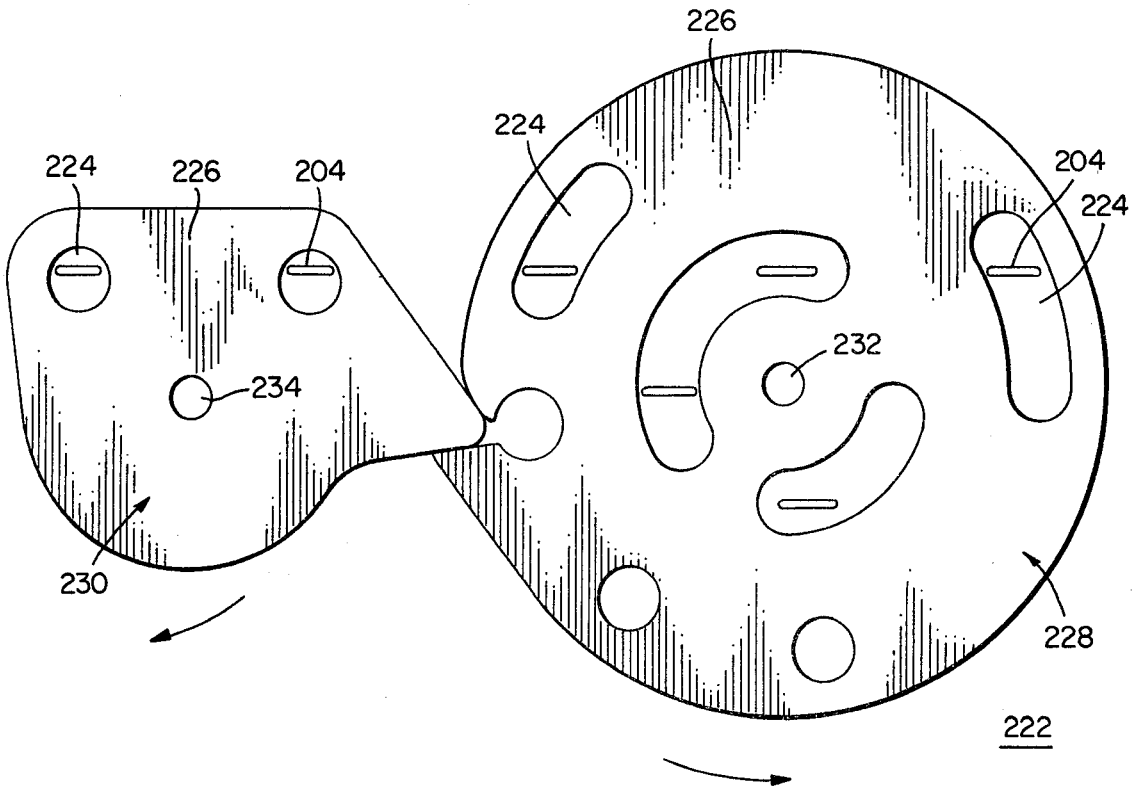
FIG. 14 is a top plan view of the selection dial of this further embodiment of the invention.
Figure 15:
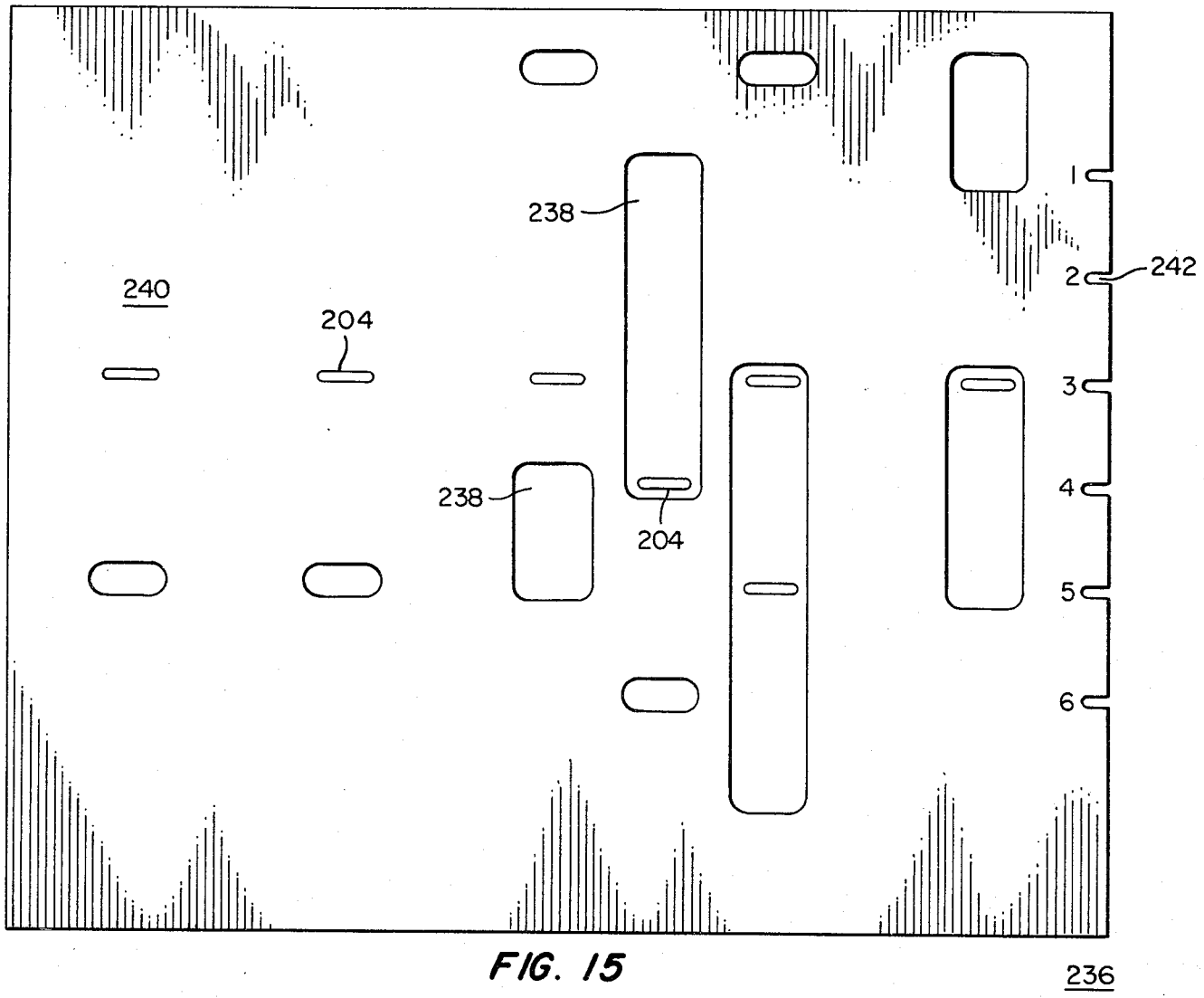
FIG. 15 is a top plan view of a selection plate usable with the further embodiment of the invention.

The selection plate 222 is shown in greater detail in FIG. 14 where it is shown as two parts, circular portion 228 and irregular portion 230. In the position shown the selection plate 222 will insure all slots 224 appear so as to prevent any punch from being extended during the connector crimping cycle. Portion 228 rotates about a pivot pin 232 while portion 230 rotates about pivot pin 234. With this arrangement, any rotation of the portion 230 beyond the lock position will present the punches 200 a solid area 226, assuring that the neutral and ground positions will be punched. Portion 228 will present slots 224 or solid areas 226, depending upon the code chosen. The punch selection can also be done by a linearly advanced punch plate 236 as is shown in FIG. 15. Punch plate 236 has a series of slots 238 and solid areas 240 therebetween to control punches 200 in the same manner as did punch plate 222 of FIG. 14. A series of index slots 242 permit the plate 236 to be fixed with reference to a guide or indicator (not shown). At position 6 all of the punch push ends 204 enter slots 238 and no punching can take place during the connector crimping operation.

A further embodiment of a tool 250 constructed in accordance with the concepts of the invention is shown in FIGS. 16, 17, 18 and 19. As will be seen, this embodiment is more suited for use with the just described simplified punch assembly. Tool 250 has a base 252 consisting of a punch die plate and a pair of guides 254*a* and 254*b* thereon. Each of the guides 254*a* and 254*b* has a front guide surface 256*a*, 256*b*, respectively, and a rear guide surface 258*a* and 258*b*, respectively. A five-conductor cable entered from the left will engage guide surfaces 256*a* and 258*b* while one entered from the right will engage guide surfaces 256*b* and 258*a*. Cables of less numbers of conductors will be guided by guide surfaces 256*a*, and 258*b*, respectively.

Figure 17:
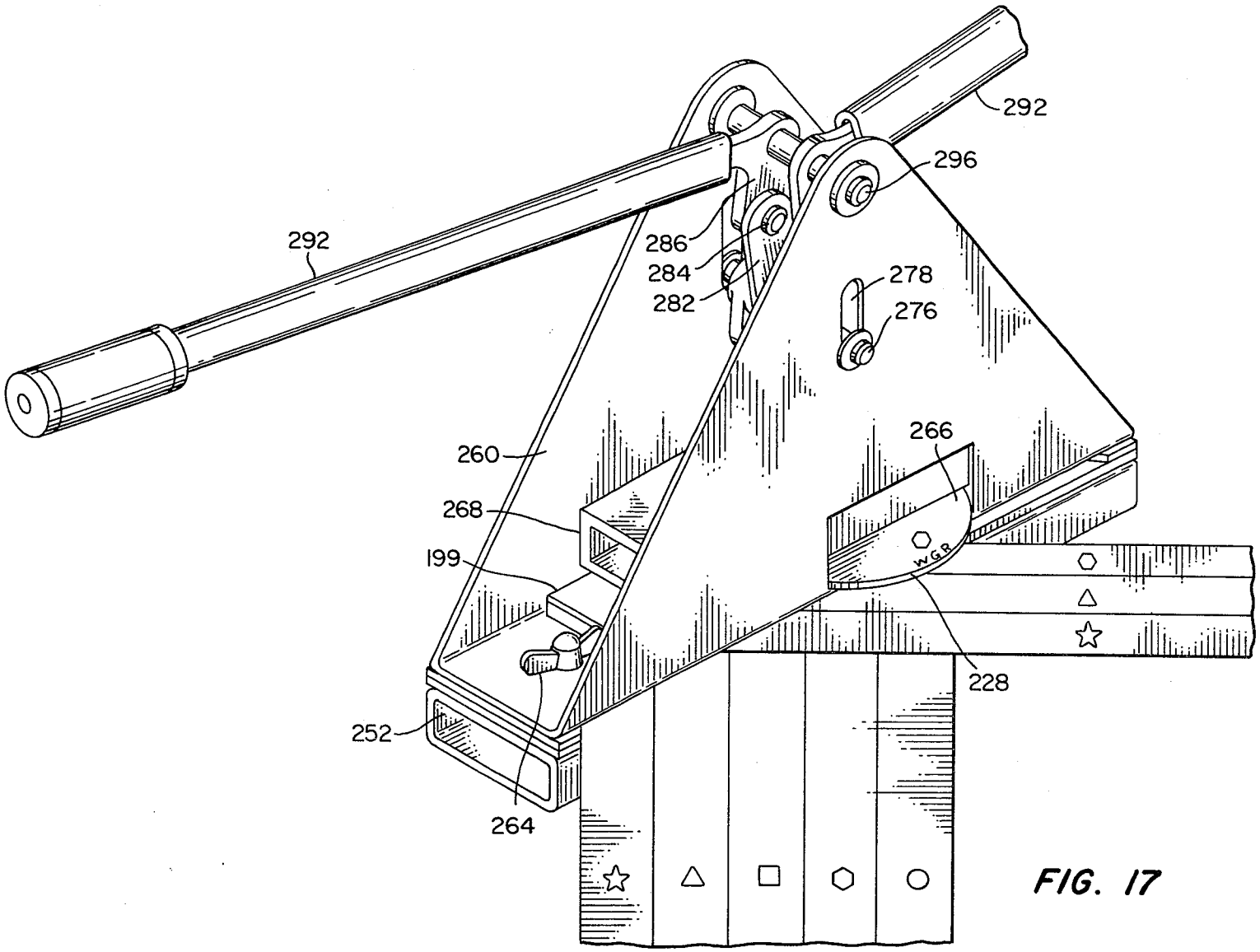
FIG. 17 is a front perspective of the tool of FIG. 16 in the closed position.
Figure 19:
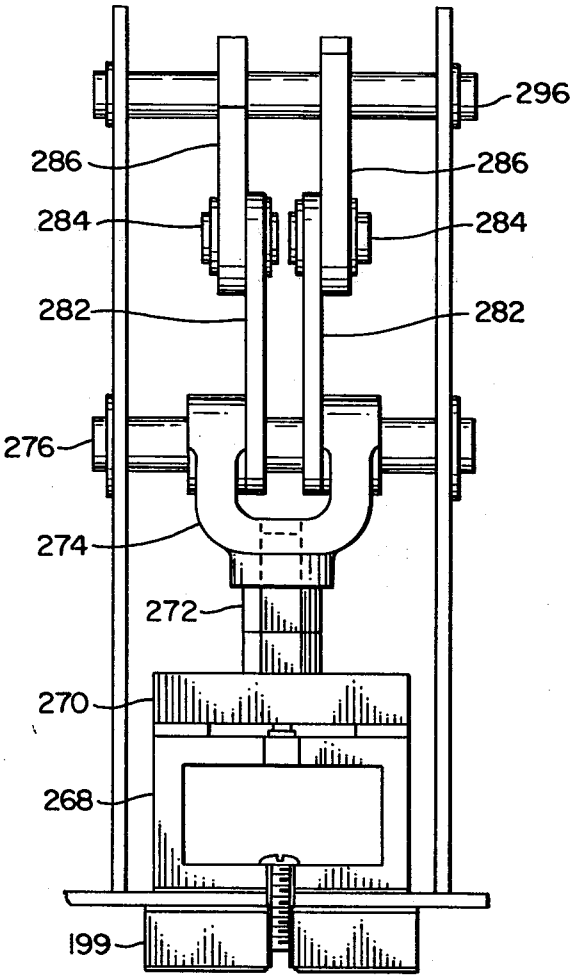
FIG. 19 is a side view of the operating mechanism of FIG. 18.
Figure 18:
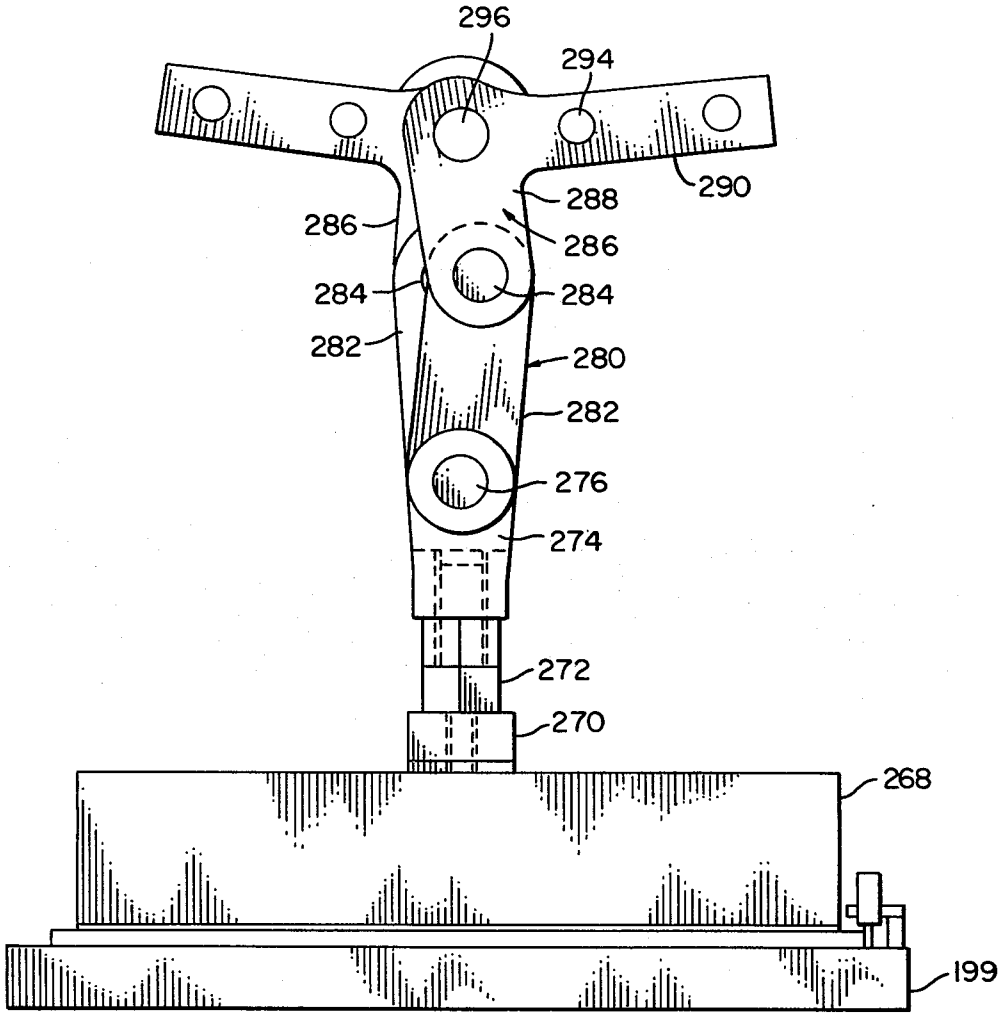
FIG. 18 is a front elevation of the operating mechanism of the tool of FIG. 16.

An upper shroud 260 is pivotally coupled to base 252 as by fastener 262 so that it may rotate in a plane parallel with the base 252 and may be fixed to base 252 by a removable fastener 264 such as the wingnut shown in FIG. 17. Within shroud 260 is the simplified punch assembly 199 as shown in FIG. 13 with a selection plate 222 directly above it, the circular portion 228 projecting through shroud 260 as a selection dial. The shroud 260 is thus the punch means driven by handles 292 to selectively operate the punch assembly 199 to punch a crimp, as required. Indicia 266 on the top of circular portion 228 shows the punch pattern for the white, green, red pattern of FIGS. 3, 4 and 5. Supporting and backing up the selection plate 222 is a punch head support 268 which is coupled to crossbar 270 which attaches directly to the gauge adjusting clevis 272. By adjusting the projection of the threaded portion (not shown) of the clevis 272 the length of stroke of the punch assembly 199 can be set. Through the clevis yoke 274 extends a pin 276 (see FIG. 19) which extends through slot 278 in each side of shroud 260. Pin 276, as it traverses slots 278, acts to guide the toggle mechanism and limit its upward and downward movements.

Coupled to pin 276, and within toggle yoke 274, are two pairs of toggle links 280, each pair (see FIG. 18) made up of a first link 282 coupled to pin 276 and a second pin 284 and a second dogleg link 286 having a lower in-line portion 288 and an upper transverse portion 290 arranged to be fixed to handles 292 by suitable fasteners through apertures 294. A further pin 296 extends through the second links 286 and is anchored in an aperture 297 (see FIG. 20) in shroud 260. This dual handle, dual toggle mechanism found in the embodiments of FIGS. 6, 16 and 17 provides two handed symetric operation of the tools 120 and 250 balancing the loading about the tools centerline to avoid any tendency for tipping during use.

Figure 16:
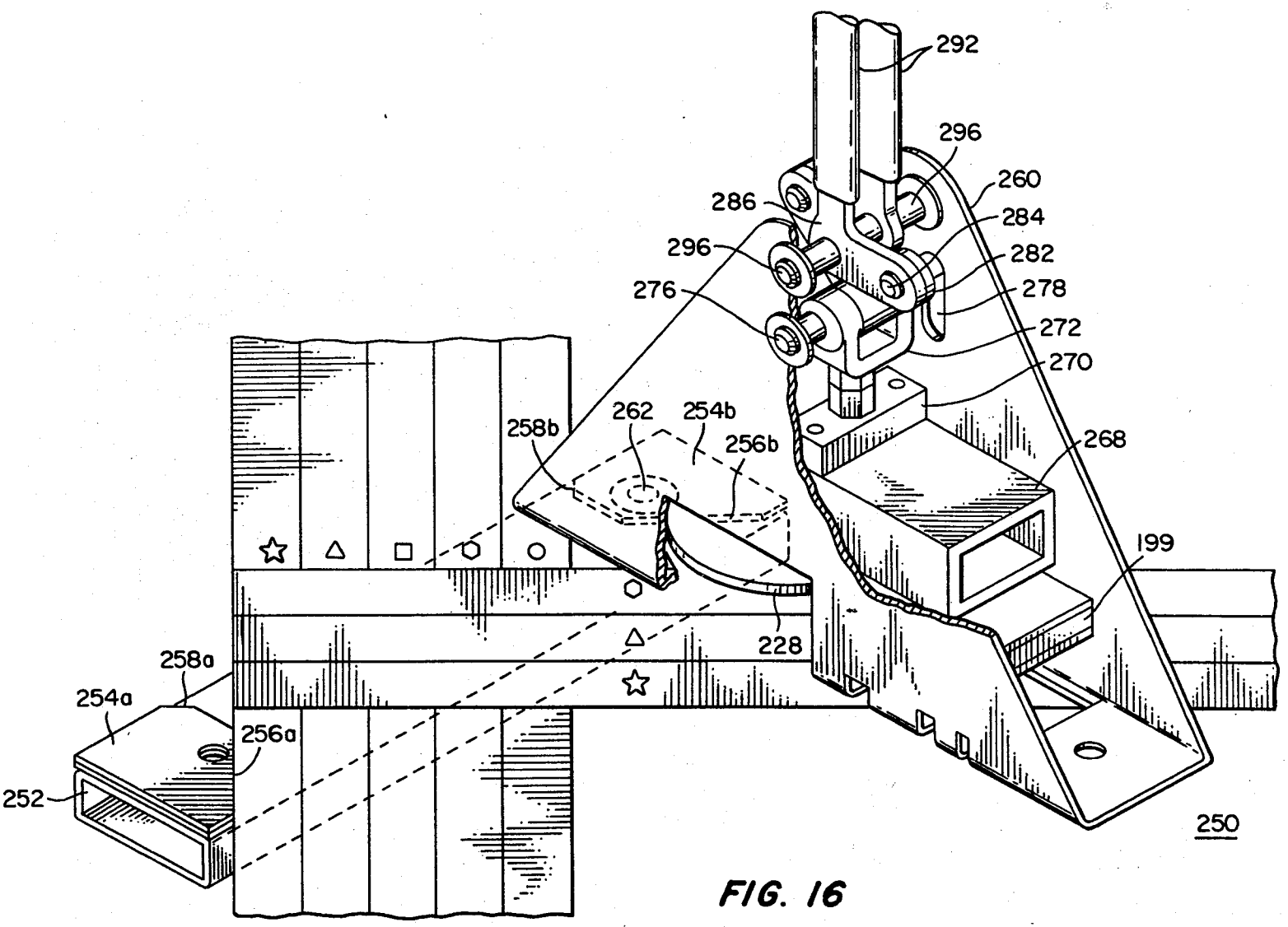
FIG. 16 is a front perspective of this further embodiment of a tool in the open position.

Tool 250 is shown in FIG. 16 in its open position, that is, with the punches 200 withdrawn and the shroud 260 moved away from the base 252. The handles 292 are also upright and together. In moving the handles 292 to the upright position, they are rotated about pivot pin 296 towards one another. This rotates portion 288 of the second link 286 in a counterclockwise direction about pin 296 and similarly rotates the pin 284. As the spacing between pins 296 and 284 decreases, along an axis between the pins 276 and 296, first link 282 is drawn upwardly towards pin 296, moving pin 276 along slot 278 and drawing clevis 272 upwardly towards pin 296. This upward movement of the clevis 272 serves to withdraw the punch assembly 199. The downward and separation movement of the handles 292, as is shown in FIG. 17, reverses the above procedure and moves the punch assembly 199 to the punch position.

Figure 20:
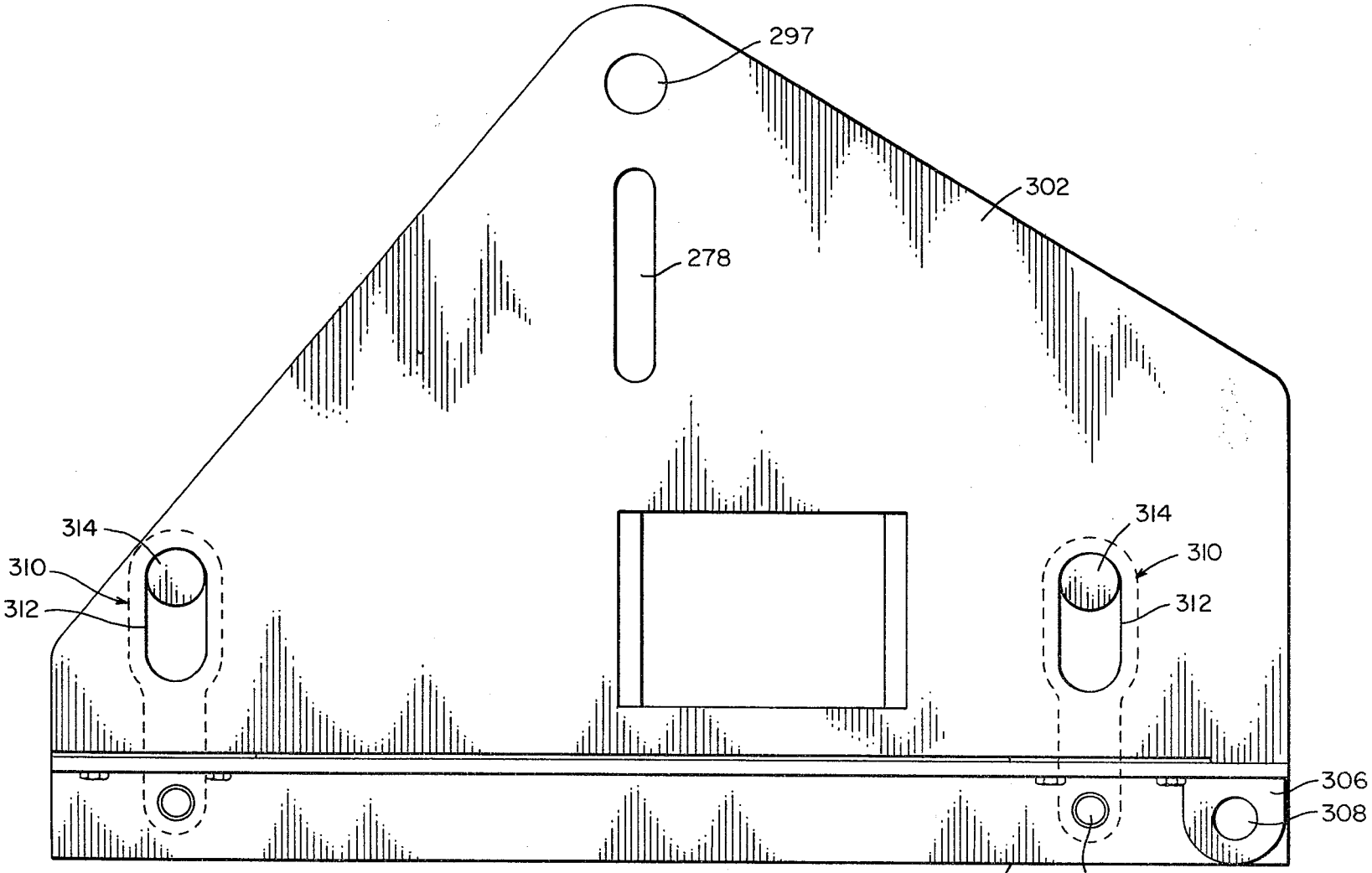
FIG. 20 is a front elevation of yet a further embodiment of a tool constructed in accordance with the concepts of the invention.
Figure 21:
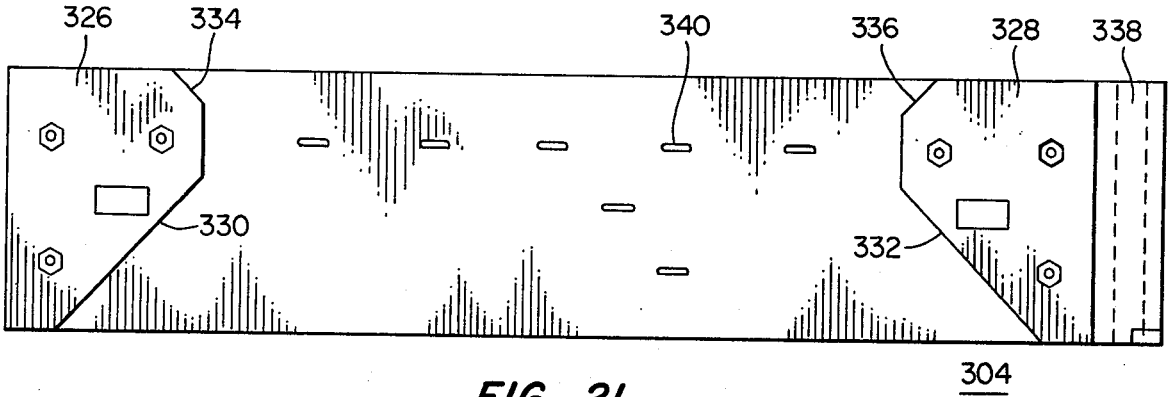
FIG. 21 is a top plan view of the base plate of the tool of FIG. 20.
Figure 22:
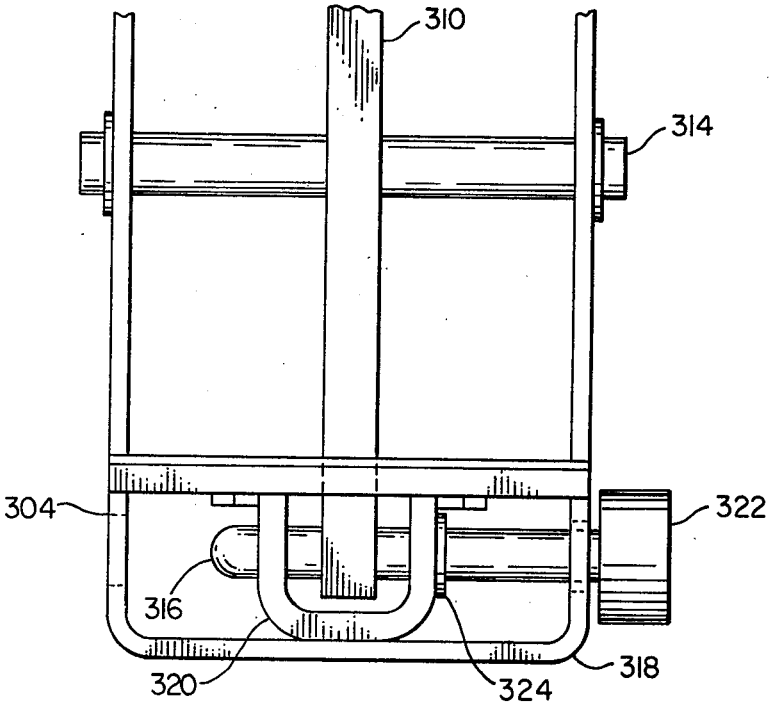
FIG. 22 is a partial end view of the tool of FIG. 20.

A further embodiment of a tool 30 is shown in FIGS. 20, 21 and 22 which permits the shroud 302 to be rotated away from the base 304 in a plane perpendicular to the plane of the base 304. This places less stress upon the coupling between the base and the shroud than does the arrangements of FIGS. 6 and 16 and 17 wherein the shroud rotates in a plane parallel to the base and the full weight thereof is unsupported when in the open position and more subject to unintended contact by workmen using the tools. In the tool of FIG. 20 a set of ears 306 with apertures 308 therethrough are placed at the rear end on the underside of shroud 302. A pin (not shown) may then be inserted through one ear 306 through a corresponding aperture (not shown) in base 304 and through the remaining ear 306 (not visible). The shroud 302 can then be rotated to the open and closed positions about such pin.

To hold shroud 302 and base 304 together two straps 310 are employed. Each strap 310 has a large looped end 312 which fits about a pin 314 permanently mounted to the shroud 302. The large looped end 312 permits the strap 310 to be lifted up beyond any confines of the base, or to rotate as the shroud 302 is opened. At the opposite end of the strap 310 is an aperture 314 through which passes a pin 316, as is best seen in FIG. 22. The base 304 is made up of two U-shaped channels, one inside the other, outer channel 318 and an inner channel 320. Apertures (not visible) extend through both legs of inner channel 320 in which the opposite end of strap 310 is centered so that pin 316 can pass through first one channel leg aperture 314 and then the other channel leg. Pin 316 also passes through an aperture (not visible) in the other channel 318. A head 322 on pin 316 makes the pin 316 easy to withdraw and reinsert. A washer or other device 324 can be used to prevent the pin 316 from being fully withdrawn and perhaps lost.

To release the shroud 302, one has only to withdraw pins 316 far enough to exit aperture 314 and leave straps 310 unanchored. Similarly, pins 316 have but to reenter the aperture 314 in strap 310 and the aperture 314 in inner channel 320 to reassemble the shroud 302 and base 304.

Turning now to FIG. 21, there is shown base 304 in detail. Guides 326 and 328 have front guide surfaces 330 and 332, respectively, and rear guide surfaces 334 and 336, respectively. A five-conductor flat cable introduced from the left would contact guide surfaces 330 and 336, whereas a cable of a lesser number of conductors would contact guide surface 330 only. Similarly, a five-conductor flat cable introduced from the right will contact guide surfaces 332 and 334, while a cable of fewer conductors would contact guide surface 334 only. Aperture 338 is arranged to receive the same pin as will pass through the apertures 308 of the ears 306 of shroud 302 to permit same to be rotated with respect to base 304. Apertures 340 provide the die portions of the base and correspond to the punch positions and receive the punches 200 after same have passed through the cables.

To summarize what has been described hereinbefore, the tool 120 or 250 is set by means of selection devices 148, 194, 222 or 236 to a desired punch pattern and the tool 120 or 250 is operated using handles 140 or 292, respectively to punch the flat cables placed upon the bases 122 or 252, respectively. Once the punch operation has been completed, a connector of the type shown at 112 is inserted in each punched slot 110.

With tool 120 the punch assembly is displaced from the tool base either completely or pivotably, as shown in FIG. 6. With a tool of the type 250 using a punch assembly as shown in FIG. 13 the selection devices 222 or 236 is set to a crimping position wherein no punch can be operated and the handles 140 or 292 are operated again to crimp each connector 112 to the flat cable simultaneously making the desired electrical connection between the cables.

While there have been shown and described and pointed out the fundamental novel features of the invention as applied to the preferred embodiment, it will be understood that various omissions and substitutions and changes of the form and details of the devices illustrated and in its operation may be made by those skilled in the art, without departing from the spirit of the invention.

The embodiments of the invention in which an exclusive property or privilege is claimed are defined as follows:

1. A tool for selectively applying at least three connectors to two or more multiconductor cables to selectively interconnect individual conductors of each of such multiconductor cables comprising: a base member atop which the multiconductor cables are placed; punch means arranged to be driven towards and away from said base member; drive means coupled to said punch means to selectively drive said punch means towards and away from said base member; a plurality of punch assemblies comprising an equal plurality of punches positioned intermediate said base member and said punch means to be selectively operated to punch apertures in the multiconductor cables placed on said base member and crimping means to simultaneously crimp all connectors positioned in said apertures after the completion of said punch operation.

2. A tool as defined in claim 1, wherein said base member has a plurality of apertures therein corresponding in number to said punches to receive said punches after same have passed through the multiconductor cables.

3. A tool as defined in claim 1, wherein said base member has a plurality of apertures therein corresponding in number and location to said punches to receive said punches after same have passed through the multiconductor cables.

4. A tool as defined in claim 1, wherein said base member has a first edge guide to be engaged by the edge of a first of the multiconductor cables and align same with said punches as it passes through said tool along a first path.

5. A tool as defined in claim 4, wherein said base member has a second edge guide to be engaged by the edge of a first of the multiconductor cables and align same with said punches as it passes through said tool along a second path perpendicular to said first path, said second edge guide also permitting the alignment of a second multiconductor cable with the first multiconductor cable as the cables pass orthogonally through said tool.

6. A tool as defined in claim 1, wherein said base member has a first guide means and a second guide means to be simultaneously engaged by the parallel, longitudinal edges of a multiconductor cable to align said cable with said punches as it passes through said tool along a first path.

7. A tool as defined in claim 6, wherein said base member has a third and a fourth guide means to be simultaneously engaged by the parallel, longitudinal edges of a multiconductor cable to align said cable with said punches as it passes through said tool along a second path perpendicular to said first path, said third and fourth edge guides also permitting the alignment of a second multiconductor cable with the first multiconductor cable as the cables pass orthogonally through said tool.

8. A tool as defined in claim 1, wherein said base member is rotatably coupled to said punch means.

9. A tool is defined in claim 8, wherein said punch means is rotatably connected to said base member for rotation in a plane parallel with said base member.

10. A tool as defined in claim 8, wherein said punch means is rotatably connected to said base member for rotation in a plane perpendicular with said base member.

11. A tool as defined in claim 9, wherein said punching means and said base member are held in alignment by fastening means.

12. A tool as defined in claim 9, wherein said punching means and said base member are held in alignment by removable fastening means.

13. A tool as defined in claim 10, further comprising latch means comprising at least one strap member coupled to said punching means and to said base member.

14. A tool as defined in claim 10, further comprising latch means comprising at least one strap member coupled to said punching means and releasably coupled to said base member to permit said punching means to be rotatably moved away from said base member upon the release of the coupling to said base member.

15. A tool as defined in claim 1, wherein said punch assembly comprises: a frame member having a first face and a second, spaced apart parallel face and a plurality of bores therein extending through said frame member and opening on said first face and said second face thereof; a plurality of punches, one for each bore and a plurality of resilient means, one for each punch and acting upon its associated punch to position said punch adjacent said second face while a portion of said punch extends through and above said first face, said punches operated by engaging the portion of said punch extending above said frame and reset by said resilient means.

16. A tool as defined in claim 15, further comprising slide means, one for each punch extending within said frame adjacent said first face and coacting with an aperture in said punch to retain said punch within said bore.

17. A tool as defined in claim 16, wherein said frame member first face further defines a plurality of slots, one for each and adjacent one of said punches, said slots providing access to said slide means to permit said slide means to be withdrawn or inserted in said punch allowing said punches to be selectively withdrawn or locked within said frame member.

18. A tool as defined in claim 1, wherein said punch assembly comprises: a frame member having a first face and second, parallel, spaced apart face with a plurality of bores extending and opening into said first face and said second face; and a plurality of punches, one for each bore and each loosely fitting within its associated bore; each of said punches having a punch end and a push end, said punch end arranged to selectively extend through said bore and beyond said second face and said push end arranged to selectively extend through said bore and beyond said first face.

19. A tool as defined in claim 1, wherein said punch means comprises a selection device to selectively operate the punches of the punch assembly to punch apertures in selected ones of the conductors of the multiconductor cables.

20. A tool as defined in claim 19, wherein said selection device has a plurality of indicia thereon corresponding to the selected ones of the apertures to be punched in the conductors of the multiconductor cables to permit selection of the apertures to be punched.

21. A tool as defined in claim 19, wherein said selection device is a rotatable member defining a plurality of apertures, each aperture able to accept therein a portion of one of said punches; the rotary position to which said rotatable member has been advanced, causing the punching of said multiconductor cables when said portion of said punch is adjacent said rotatable member solid portions and preventing punching when said portion of said punch is adjacent to and enters its associated aperture.

22. A tool as defined in claim 18, wherein said punch means comprises a selection device comprising a rotatable member defining a plurality of apertures, each aperture capable of accepting therein the push end of its associated one of said punches; the rotary position to which said rotatable member has been advanced causing the punching of said multiconductor cables when said push end is adjacent said rotatable member solid portions and preventing punching when said push end is adjacent to and enters its associated aperture.

23. A tool as defined in claim 19, wherein said selection device is a sliding indexible plate defining a plurality of apertures, each aperture able to accept therein a portion of one of said punches, the linear position to which said sliding plate has been advanced causing the punching of said multiconductor cables when said portion of said punch is adjacent said slidable plate solid portions and preventing punching when said portion of said punch is adjacent to and enters its associated aperture.

24. A tool as defined in claim 18, wherein said punch means comprises a selection device comprising a sliding indexible plate defining a plurality of apertures, each aperture capable of accepting said push end of its associated one of said punches; the linear position to which said sliding plate has been advanced causing the punching of said multiconductor cables when said push end is adjacent said slidable plate solid portions and preventing punching when said push end is adjacent to and enters its associated aperture.

25. A tool as defined in claim 1, wherein said punch means comprises a selection device settable according to the punches of the punch assembly to be operated to punch the multiconductor cable; said punch means further comprising transfer means interposed between said selection device and said punch assembly to transfer the setting of said selection device to said punch assemblies as said punch means is driven towards said base member.

26. A tool as defined in claim 25, wherein said selection device is a rotatable member.

27. A tool as defined in claim 25, wherein said selection device is a sliding indexible plate.

* * * * *